US006705302B2

(12) United States Patent
Meinders

(10) Patent No.: US 6,705,302 B2
(45) Date of Patent: Mar. 16, 2004

(54) IGNITION DEVICE FOR AN INTERNAL COMBUSTION ENGINE

(75) Inventor: Horst Meinders, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 105 days.

(21) Appl. No.: 10/022,790

(22) Filed: Dec. 17, 2001

(65) Prior Publication Data

US 2002/0134363 A1 Sep. 26, 2002

(30) Foreign Application Priority Data

Dec. 16, 2000 (DE) ..... 100 62 892

(51) Int. Cl.[7] ..... F02P 3/08; F02P 15/00

(52) U.S. Cl. ..... 123/620; 123/640; 123/655; 123/656

(58) Field of Search ..... 123/620, 640, 123/641, 655, 656

(56) References Cited

U.S. PATENT DOCUMENTS 4,059,084 A * 11/1977 Jundt ..... 123/620
4,301,782 A * 11/1981 Wainwright ..... 123/620
4,641,626 A * 2/1987 Morino et al. ..... 123/620
5,220,901 A * 6/1993 Morita et al. ..... 123/620 X
6,123,063 A * 9/2000 Boerjes ..... 123/620 X

* cited by examiner

*Primary Examiner*—Tony M. Argenbright
(74) *Attorney, Agent, or Firm*—Kenyon & Kenyon

(57) ABSTRACT

An ignition device for an internal combustion engine having multiple cylinders and direct gasoline injection is described, so that the secondary current conduction time of the ignition coil can be prolonged controllably without increasing the primary current. At least one ignition coil is provided for each cylinder of the internal combustion engine. The primary side of the ignition coil is switched over an ignition switch which is triggered by a microprocessor. A spark plug is connected to the secondary side of the ignition coil. An external voltage can be applied to the ignition coil to prolong the secondary current conduction time, thus supplying the power required for the prolonged secondary current.

30 Claims, 9 Drawing Sheets

IGNITION DEVICE FOR AN INTERNAL COMBUSTION ENGINE

FIELD OF THE INVENTION

The present invention relates to an ignition device for an internal combustion engine having multiple cylinders and direct gasoline injection, at least one ignition coil being provided for each cylinder, the primary side of the ignition coil being switched by an ignition switch controlled by a microprocessor and a spark plug being connected to the secondary side of the ignition coil.

BACKGROUND INFORMATION

In direct gasoline injection, gasoline is injected into the combustion chamber of a cylinder, where it is evaporated and ignited by the secondary high voltage of the ignition coil. If the secondary current is cut off too soon, uncombusted or partially combusted gas may escape. To guarantee reliable operation with low exhaust emissions, several ignition sparks, for example, can be produced by double coil ignition or pulse train ignition. In addition, the secondary current can be prolonged.

In principle, the duration of the secondary current can be prolonged by increasing the primary current in the ignition coil, because this increases the energy transferred to the secondary side. Such an energy increase, however, is counteracted by the coil saturation that occurs with an increase in the primary current and the increasing power losses in the ignition coil, preventing an effective increase in the secondary current and its duration. In addition, the ignition output stage and the ignition coil may be overloaded thermally by high switching currents. Therefore, this measure for prolonging the duration of the secondary current should be limited only to those operating states in which it is absolutely necessary, such as a cold start, to avoid unnecessary bum-up of the spark plugs. In all other operating states, it should be possible to switch back to the "natural" secondary current conditions.

SUMMARY Of THE INVENTION

The present invention provides an ignition device for an internal combustion engine with which the secondary current conduction time of the ignition coil can be prolonged controllably without increasing the primary current.

This is achieved according to the present invention by applying an external voltage to the ignition coil to prolong the secondary current conduction time.

The present invention is based on the recognition of the fact that the secondary current conduction time can be prolonged if an external voltage which supplies the power required for the prolonged secondary current is applied at the primary side or at the secondary side of the ignition coil.

Although it is possible in principle to supply an external voltage on the secondary side of the ignition coil, this is difficult because of the high voltage (30 kV) occurring on the secondary side, so that the external voltage can advantageously be applied to the primary side of the ignition coil.

There are essentially various options for implementation of the ignition device according to the present invention.

In a first advantageous variant of the present invention, the secondary current in the ignition coil is prolonged by controlled switching on and switching off of an auxiliary voltage source on the primary side. In this variant, the starter hardware known from practice can be used without conversion. In the future, a 14-volt voltage source operated via the ignition coil as well as a 42-volt voltage source will be available in motor vehicles, the latter then being available for use as an auxiliary voltage source to advantage.

In a second advantageous variant of the present invention, the secondary current in the ignition coil is prolonged with the help of the cut-off voltage of an auxiliary circuit having an auxiliary switch and an external inductor. The auxiliary transistor is switched off shortly before the end of the "natural" secondary current. This variant requires a second inductor and under certain circumstances also requires redesign of the ignition coil.

A third variant of the present invention makes use of the fact that prolonging the combustion time in direct gasoline injection is usually the goal in the case of single-spark coils, where an attached or external ignition switch and a rod coil can always be allocated to one cylinder of the engine. In this case, there are several inactive coil-ignition switch combinations for each active coil-ignition switch combination at any given moment, so that in the case of engines having an even number of cylinders, an inactive coil-ignition switch combination can be associated with each disconnecting coil-ignition switch combination. It is also conceivable to have an association such as that in the case of double coil ignition, where a parasitic spark is ignited in the exhaust. In the case of the ignition device according to the present invention, however, no ignition sparks should be produced by the passive coil-ignition switch combination. The passive coil-ignition switch combination should contribute only to prolonging combustion time. It is important that once the association of coil-ignition switch combinations has been made, it is reversible. In other words, when one coil-ignition switch combination generates an ignition spark, the associated coil-ignition switch combination serves only to prolong the combustion time and vice versa.

5 in the case of different switching on and switching off times of the auxiliary circuit.

Figure 5:
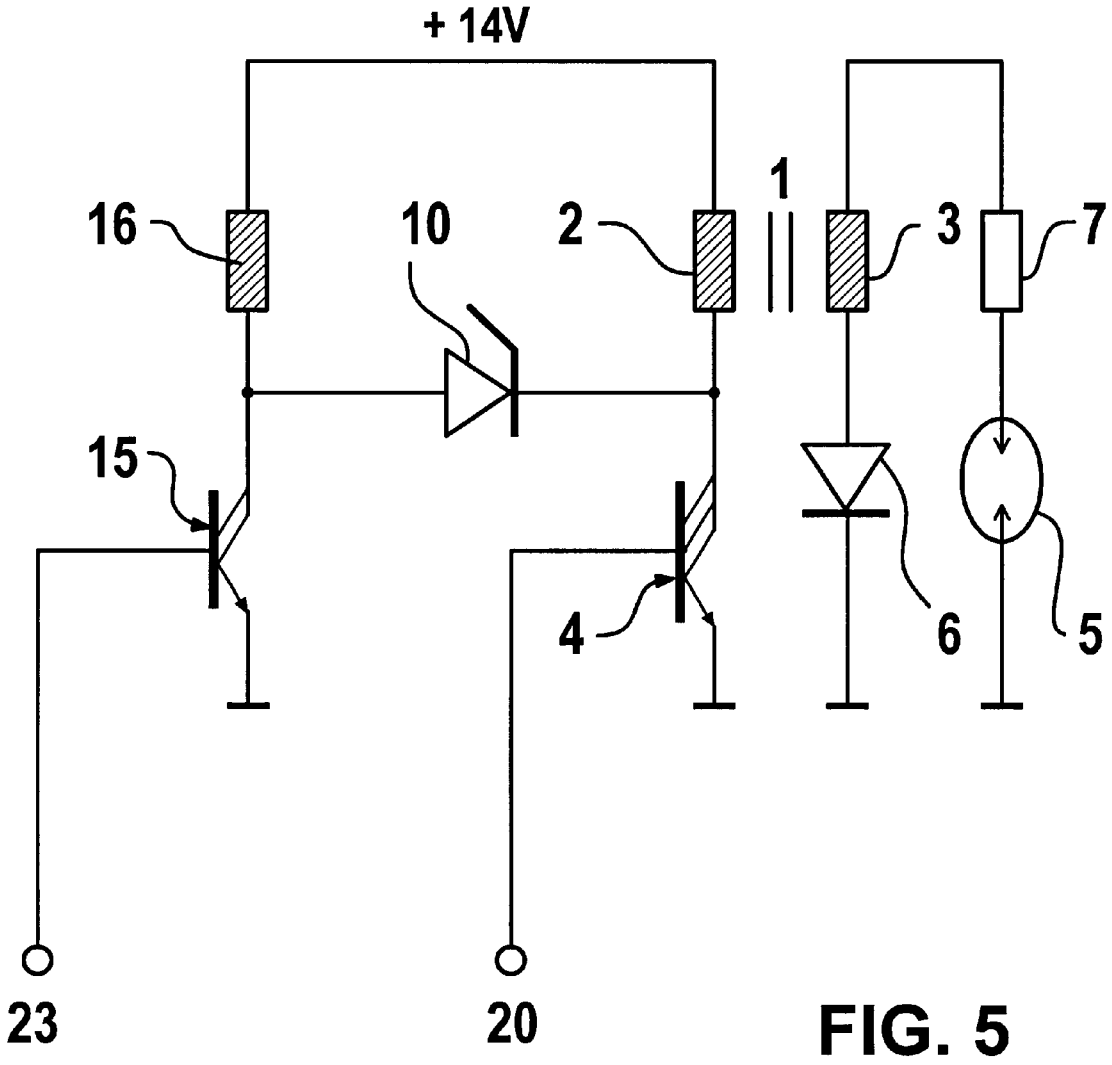
FIG. 5 shows the schematic diagram of an ignition device according to the present invention with which the combustion current is prolonged using the cut-off voltage of an auxiliary circuit.
Figure 7:
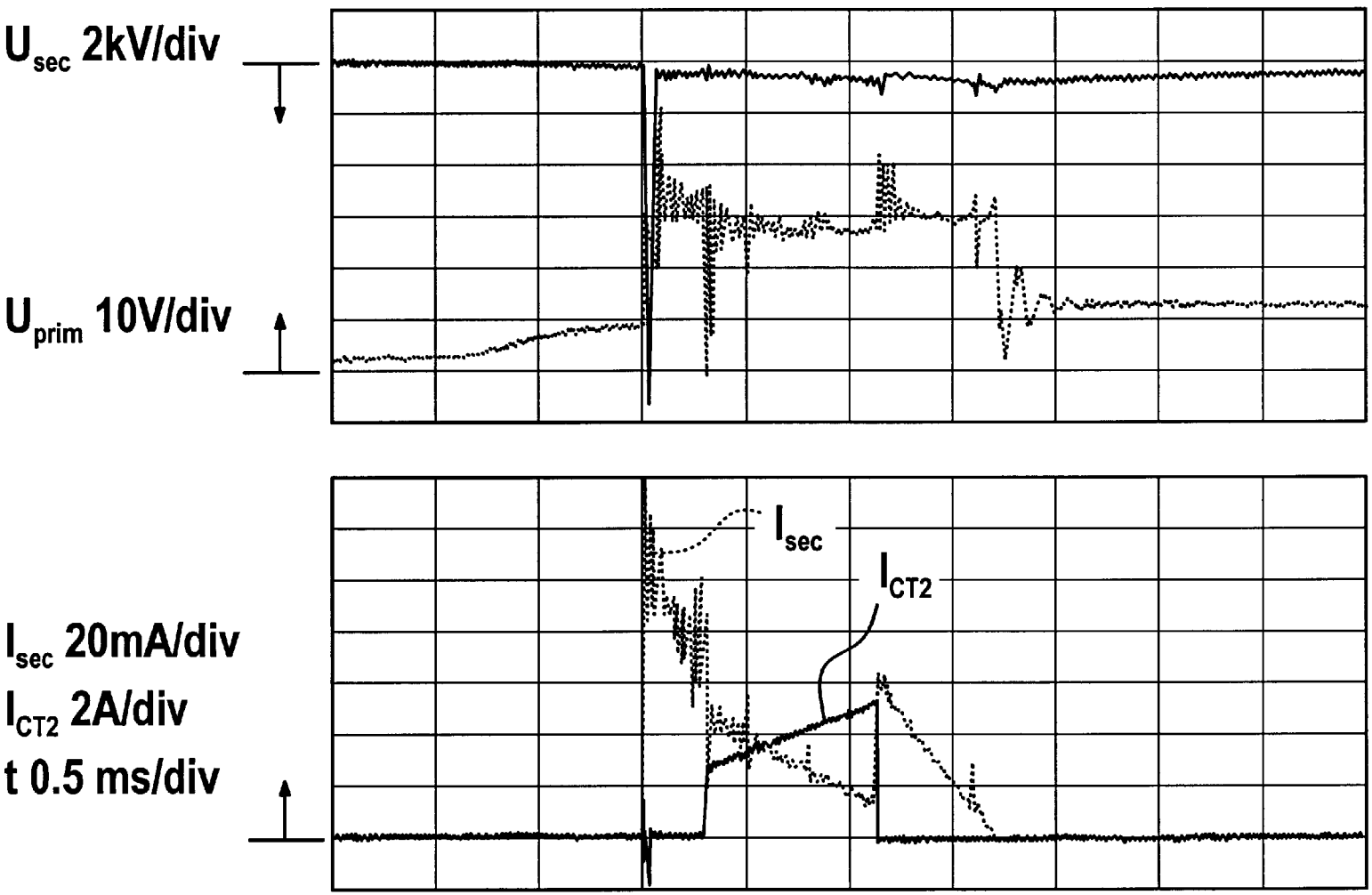

FIG. 7 shows a second illustration of the time characteristics of secondary voltage $U_{sek}$, primary voltage $U_{prim}$ and secondary current $I_{sek}$ for the ignition device illustrated in FIG. 5 in the case of different switching on and switching off times of the auxiliary circuit.

Figure 8:
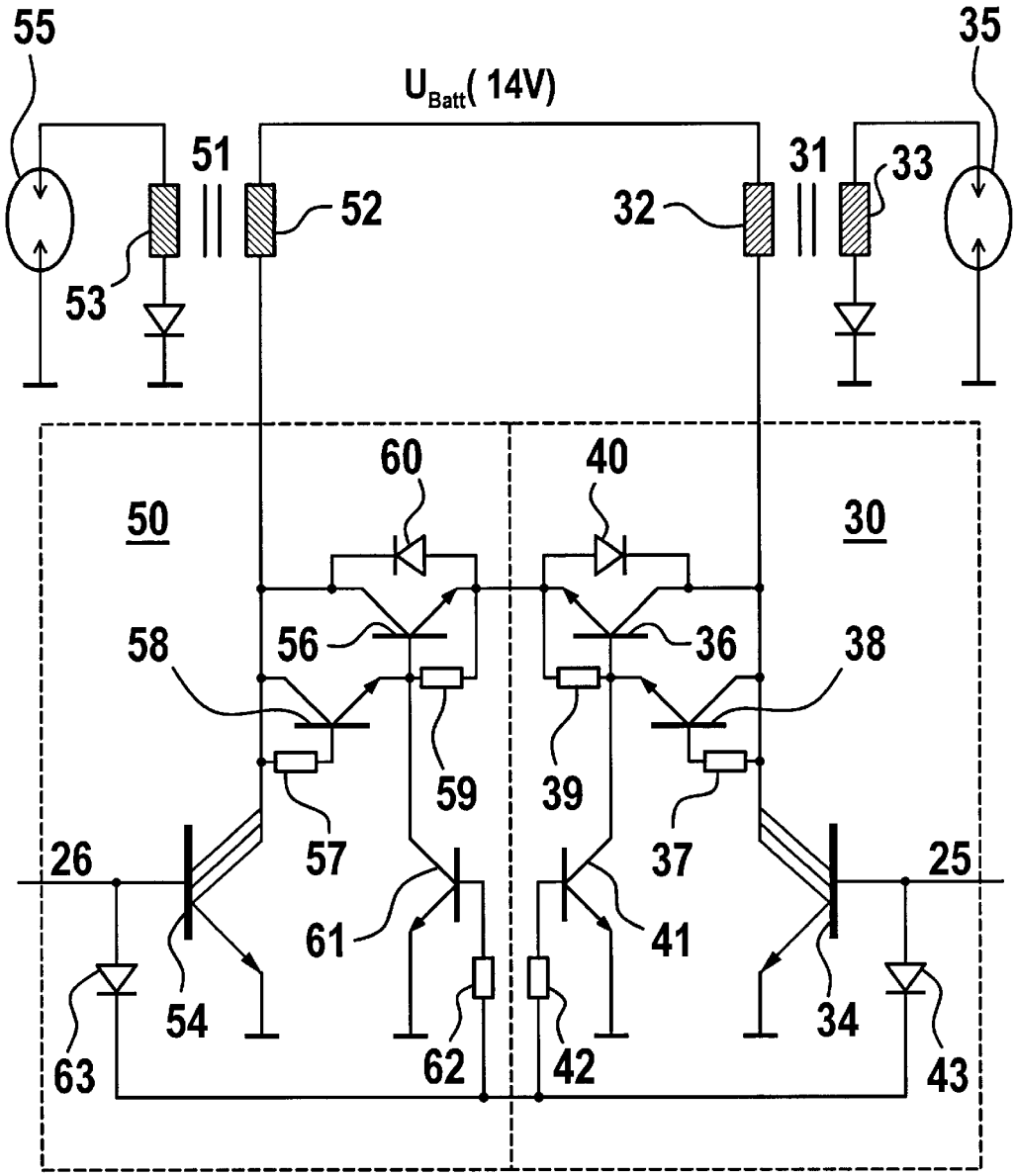

FIG. 8 shows the schematic diagram of an ignition device according to the present invention, in which two ignition trigger systems are connected in series for reciprocal recharging.

Figure 9:
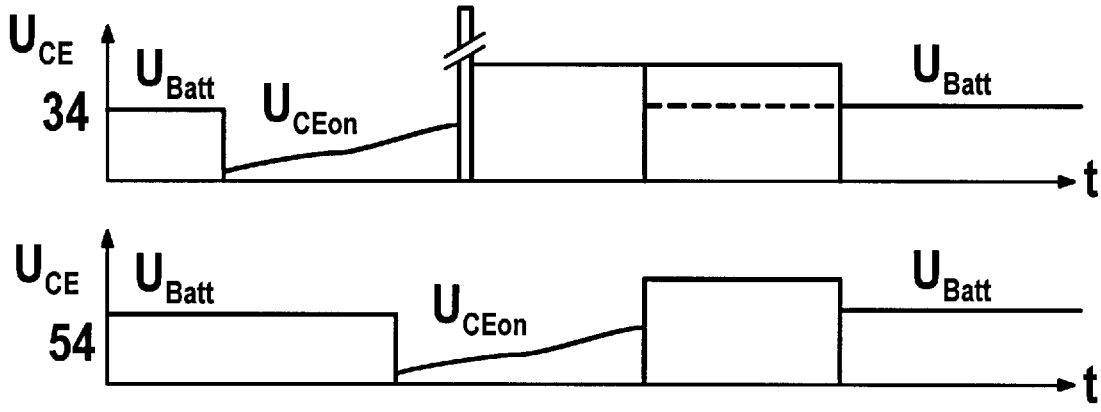

FIG. 9 shows a schematic diagram of the collector-emitter voltages of the two ignition Darlingtons of the circuitry illustrated in FIG. 8.

Figure 10:
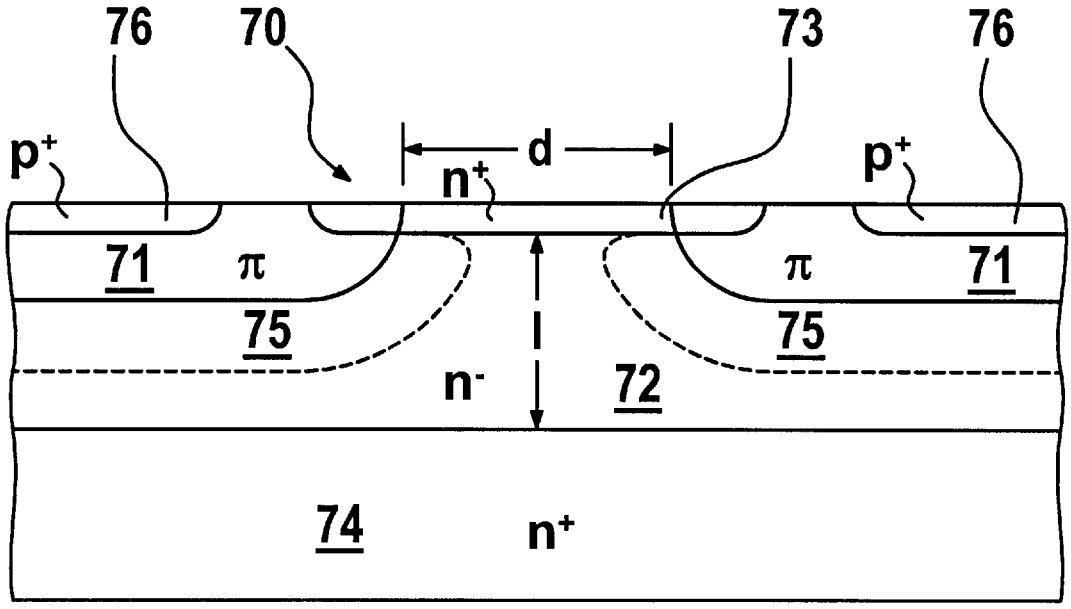

FIG. 10 shows the construction of a J-FET-like construction of a resistor with a narrowed cross section such as that used with the ignition device illustrated in FIG. 8.

DETAILED DESCRIPTION

Figure 1:
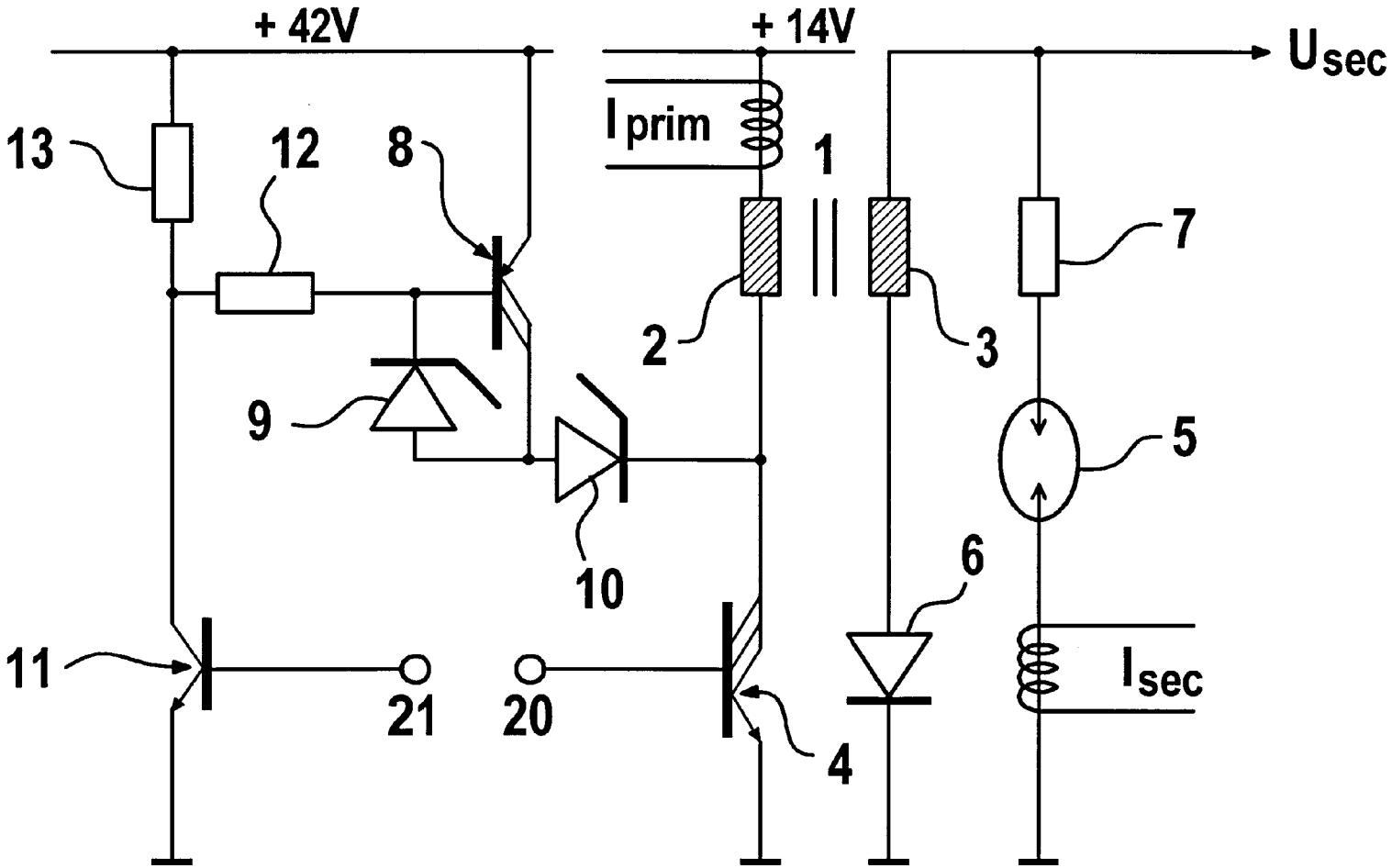
FIG. 1 shows the schematic diagram of an ignition device according to the present invention, in which the combustion current is prolonged by connecting a fixed voltage source to the primary side of the ignition coil.

FIG. 1 shows the principle of an ignition device according to the present invention for a cylinder of a internal combustion engine having direct gasoline injection or for an ignition coil 1. Primary side 2 of ignition coil 1 is operated at 14 volts and is switched by an ignition switch 4 controlled via 20. Ignition switch 4 is implemented here in the form of a bipolar ignition Darlington 4, or as an alternative, an IGBT could also be used as the ignition switch.

The connection time and connection duration of ignition switch 4 are set by a microprocessor (not shown here). Secondary side 3 of ignition coil 1 is connected to ground over diode 6, which suppresses the switch on ignition, and to a spark plug 5 over an interference-suppression resistor 7.

To prolong the combustion current, a fixed voltage source, namely a 42-volt battery in this case, is connected for a defined period of time to primary side 2 of ignition coil 1. To do so, the fixed voltage source is connected to primary side 2 of ignition coil 1 via a high-side switch in the form of a pnp-Darlington 8. pnp-Darlington 8 is clamped with a Z50 Zener diode 9 to handle the load-dump voltage of more than 50 V occurring at the 42-volt fixed voltage source. As an alternative to the pnp-Darlington shown here, an n-MOSFET could also be used for connecting the fixed voltage source.

Decoupling diode 10 is connected between the high-side switch and primary side 2 of the ignition coil, or more precisely between the collectors of pnp-Darlington 8 and ignition Darlington 4, so that the clamping of ignition Darlington 4 does not influence the process of activation of the high-side switch taking place independently thereof. Decoupling diode 10 here is a high-blocking Zener diode which exceeds the value of the clamping voltage of ignition Darlington 4, namely 410 volts in the example shown here.

For accurate timing of the connection of the fixed voltage source at the end of the combustion current after charging ignition Darlington 4, a npn-switching transistor 11 controlled via 21 is connected upstream from the base of pnp-Darlington 8. For this purpose, the collector of the npn-switching transistor 11 is connected to the base of pnp-Darlington 8 across a 100 Ω resistor 12 and is connected to the fixed voltage source across a 2 kΩ resistor 13.

With regard to the integratability of the circuit illustrated in FIG. 1, it should be pointed out that the decoupling diode 10 can be integrated into the ignition Darlington 4. The pnp-Darlington 8 can be integrated into the control IC in bipolar CMOS-DMOS (BCD) technology. Since a dielectric strength of 80 V can be achieved in BCD technology, pnp-Darlington 8 is secured with the 50-volt Zener diode against load-dump voltages of 60 V occurring at the 42-volt fixed voltage source. Because of the reduced current requirements, the area of ignition Darlington 4 may be reduced significantly. However, a portion of the emitter area thus saved is used for decoupling diode 10.

Figure 2:
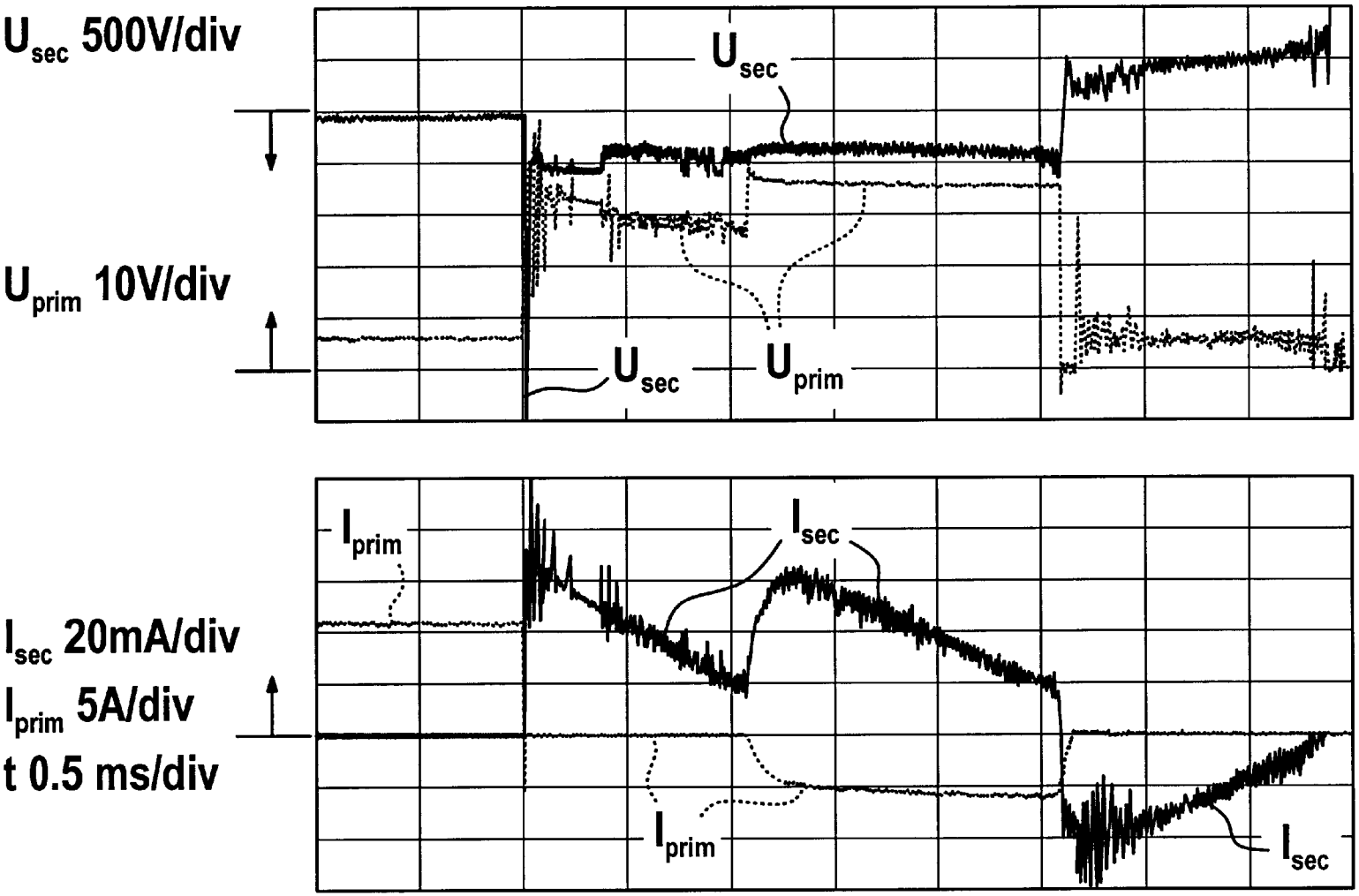
FIG. 2 shows a first illustration of the time characteristics of secondary voltage $U_{sek}$, primary voltage $U_{prim}$ and secondary current $I_{sek}$ in comparison with primary current $I_{prim}$ for the ignition device illustrated in FIG. 1 in the case of various switching on and switching off times for the fixed voltage source.

FIG. 2 shows the primary current $I_{prim}$ measured on the supply side of primary coil 2 as illustrated in FIG. 1, and then the inverse current flowing from the 42-volt fixed voltage source over pnp-Darlington 8 through decoupling diode 10 and through primary coil 2 to the 14-volt voltage source. Furthermore, this also shows the three phases of secondary current $I_{sek}$ (measured as shown in FIG. 1), primary voltage $U_{prim}$ and secondary voltage $U_{sec}$. The first phase is the natural combustion phase, in which the current drops from 60 mA to 0 after 1.3 ms. The combustion voltage occurring on the secondary side amounts to −548 V. In the second phase, pnp-Darlington 8 is switched on. The primary voltage here is 35 V, while the secondary voltage is −345 V. After switching off pnp-D arlington 8 in the third phase, the power transmitted to secondary side 3 of ignition coil 1 drops because of the inverted direction of current flow as a negative secondary current in spark plug 5. The secondary voltage here is +550 V. The two following requirements are to be met for these three phases to occur:

1. pnp-Darlington 8 is not to be switched on too late because otherwise the secondary current drops to 0 and the ignition spark is extinguished. Then it is no longer possible to restart the ignition spark.
2. pnp-Darlington 8 is to be switched off before the secondary current drops to 0 in the second phase. If it is switched off later, as is the case in FIG. 3, the power stored on the primary side can no longer be transferred to secondary side 3 of ignition coil 1 because spark plug 5 is then no longer conducting. The current on the primary side then drops without an inverse spark current.

Figure 3:
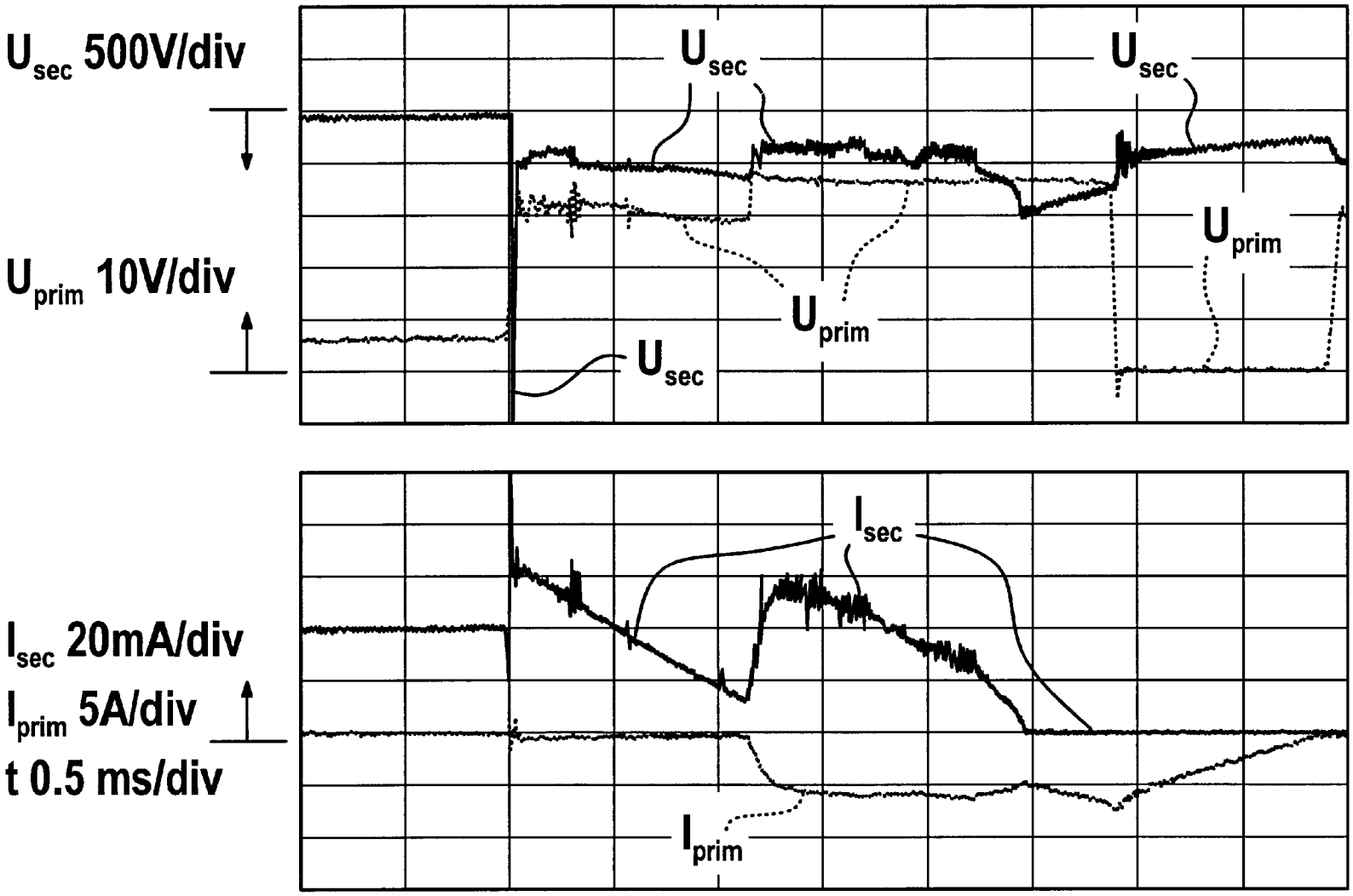
FIG. 3 shows a second illustration of the time characteristics of secondary voltage $U_{sek}$, primary voltage $U_{prim}$ and secondary current $I_{sek}$ in comparison with primary current $I_{prim}$ for the ignition device illustrated in FIG. 1 in the case of various switching on and switching off times for the fixed voltage source.
Figure 4:
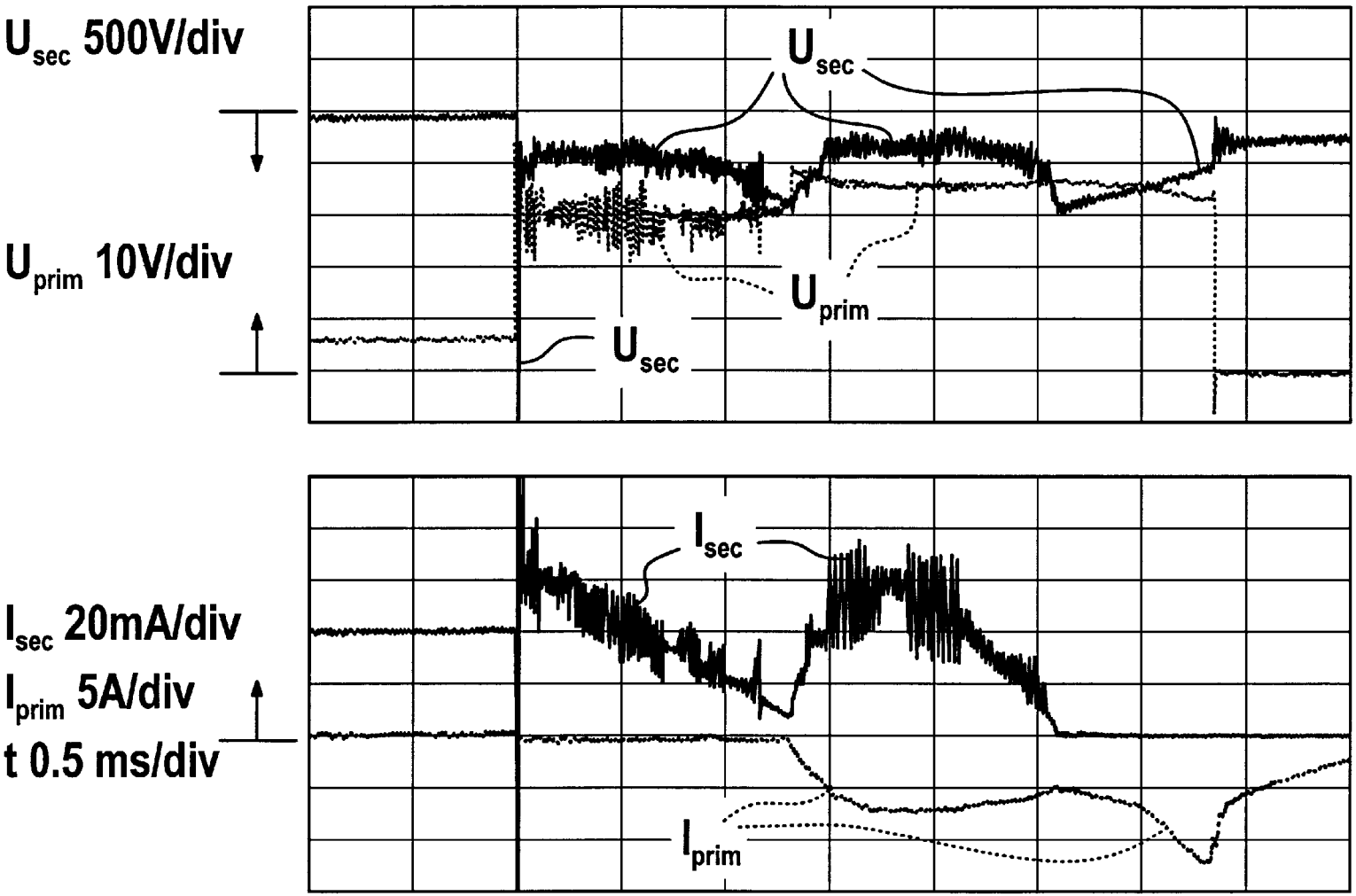
FIG. 4 shows a third illustration of the time characteristics of secondary voltage $U_{sek}$, primary voltage $U_{prim}$ and secondary current $I_{sek}$ in comparison with primary current $I_{prim}$ for the ignition device illustrated in FIG. 1 in the case of various switching on and switching off times for the fixed voltage source.

FIG. 3 illustrates the behavior of the circuit shown in FIG. 1 with an even longer on-time of pnp-Darlington 8. In this case the charging current of pnp-Darlington 8 increases from 7 A originally to more than 12 A after the combustion current drops in the second phase of combustion. Secondary coil 3, now open, no longer has a current limiting effect on pnp-Darlington 8. This high power consumption in primary coil 2 is associated with extremely long switch on times of pnp-Darlington 8 and should be prevented.

The secondary current and voltage values shown in FIG. 2 permit a rough energy estimate in the three phases, assuming a linear decay of the secondary current and a constant combustion voltage over time. The following table summarizes the corresponding relationships.

| | 1st phase of combustion | 2nd phase of combustion | Inverse combustion phase |
|---|---|---|---|
| $U_{prim}$(V) | 30 | 35 | 5 |
| $U_{sec}[[U_{sek}]](V)$ | −550 | −350 | +550 |
| $I_{sec}[[I_{sek}]]_{max}$(mA) | 60 | 60 | 60 |
| $t_{sec}[[t_{sek}]]$(ms) | 1.25 | 1.25 | 1.20 |
| $E_{sec}[[E_{sek}]]$(mWs) | 20.6 | 13.1 | 19.8 |
| Total | 20.6 | 32.9 | |

Charging of primary coil 2 with ignition Darlington 4 without taking into account the losses in ignition Darlington 4 is associated with an energy consumption of $$\frac{1}{2}\times L\times 1^2=0.5\times 2.4\times 10^{-3}\times 10\times 10=120\text{ mWs}.$$

The estimated losses in switching on ignition Darlington 4 amount to:

$$8\ V\times 10\ A\times 3\times 10^{-3}/4=60\ mWs.\ \text{Yielding as the total } 180\ mWs.$$

Recharging with pnp-Darlington 8 without taking into account the charging effect of the 42-volt fixed voltage source into the 14-volt voltage source is associated with a power consumption of $$(42-14)\times 7\times 1.25\times 10^{-3}=245\ mWs.$$

On the basis of this rough energy estimate, the ratio $E_{sec}/E_{prim}$ without recharging can be compared with that for the case of recharging:

without recharging: 20.6 mWs÷180 mWs=0.114 with recharging: 32.9 mWs÷245 mWs=0.134

This comparison illustrates that spark combustion takes place with a comparable energy efficiency in recharging from the 42-volt source as with the standard spark operation without recharging.

For the circuit illustrated in FIG. 1, the secondary currents at different charging currents are compared with the natural combustion conditions.

| | I(4) | | | | |
|---|---|---|---|---|---|
| | 1st combustion phase | 2nd combustion phase | Inverse combustion phase | | |
| | I(8) | | | | |
| | Maximum combustion current | Maximum combustion current | Maximum combustion current | Total | Prolonging |
| 3 A | 0.8 ms | 1.1 ms | 0.95 ms | 2.85 ms | 3.56 |
| 6 A | 30 mA | 45 mA | −40 mA | | |
| 5 A | 1.0 ms | 1.0 ms | 1.0 ms | 3.0 ms | 3.00 |
| 6 A | 45 mA | 50 mA | −60 mA | | |
| 7.5 A | 1.3 ms | 1.0 ms | 1.0 ms | 3.3 ms | 2.54 |
| 6 A | 75 mA | 45 mA | −40 mA | | |
| 10 A (saturation) | 1.2 ms | 1.0 ms | 0.8 ms | 3.0 ms | 2.50 |
| 6 A | 60 mA | 50 mA | −40 mA | | |
| 10 A (active) | 1.3 ms | 1.0 ms | 1.0 ms | 3.3 ms | 2.54 |
| 6 A | 60 mA | 50 mA | −50 mA | | |

As a result, the following conclusions can be reached:

1. Combustion times can be prolonged by a factor of at least 2.5 for all charging currents of ignition Darlington I(4).
2. With standard ignition, an increase in charging current I(4) from 3 A to 10 A prolongs combustion time only from 0.8 ms to 1.3 ms.
3. The ignition system having ignition coil 1 and ignition Darlington 4 can be operated with so little power that although reliable ignition is guaranteed, the "natural" secondary current lasts only a short time. Following the spark head, the secondary current is supplied from the "left branch," i.e., the 42 V fixed voltage source. This means a definite reduction in power loss for both ignition coil 1 and ignition Darlington 4, thus yielding a cost advantage and a gain in terms of reliability.
4. Prolonging the combustion current is not associated with an increase in the maximum combustion current, so spark plug burn-up is not increased.
5. By choosing a suitable engine characteristics map, combustion time can be set either short or long as needed, e.g., from 1.2 ms to 3.3 ms with all the intermediate stages. These conditions can thus be optimized for the driving situation at any given time.
6. The time pnp-Darlington 8 is switched on is to be selected so that switching still takes place at the end of the natural combustion time. If it is switched on too late, the spark current is extinguished and recharging via pnp-Darlington 8 proves to be of no benefit. Thus, reliable overlapping of the switching on time of pnp-Darlington 8 with the natural combustion time must be ensured. The same thing is also valid for the switching off time of the pnp-Darlington 8. The inverse current can flow only if it is switched off while still in the second combustion phase.

In the case of the ignition device according to the present invention as illustrated in FIG. 5, primary side 2 of ignition coil 1 is operated at 14 volts and is switched via an ignition switch 4 controlled via 20. Here again, ignition switch 4 is implemented in the form of an ignition Darlington 4. The switching-on time and duration of ignition switch 4 are determined by a microprocessor (not shown here). Secondary side 3 of ignition coil 1 is connected to ground over diode 6 and to a spark plug 5 over an interference-suppression resistor 7.

In the case of the circuit illustrated in FIG. 5, the combustion current is prolonged with the help of the cut-off voltage of an auxiliary Darlington 15 connected on primary side 2 of ignition coil 1. Auxiliary Darlington 15 is controlled with an external inductor 16 via 23. The collectors of ignition Darlington 4 and auxiliary Darlington 15 are isolated with a high-blocking Zener diode 10 which exceeds the value of the clamping voltage of ignition Darlington 4, namely 410 volts in this case, so that the clamping operation of ignition Darlington 4 does not have any effect on the operation of switching on auxiliary Darlington 15 which takes place independently. On the other hand, however, the clamping voltage of auxiliary Darlington 15 can be transferred to the collector of ignition Darlington 4. When ignition Darlington 4 is switched on, Zener diode 10 functions as a decoupling diode, and the charging current is distributed to the two inductors connected in parallel, namely primary coil 2 and external inductor 16.

The total inductance is 1.5 mH, with 2.4 mH for primary coil 2 and 4 mH for external inductor 16. The rate of rise of the collector current of ignition Darlington 4 increases with dI/dt~U/L. Activation of auxiliary Darlington 15 is timed so that its switch off phase occurs in the period of time when the combustion current produced by ignition Darlington 4 is flowing or immediately thereafter. Auxiliary Darlington 15 is then clamped with the transformed combustion voltage which is 30 V in the case of this ignition coil 1. The secondary current conduction time can thus be prolonged maximally by the clamping time of auxiliary Darlington 15, which in the case of a 6 A charging current, 4 mH external inductor 16 and a 30 V clamping voltage amounts to 0.8 ms. In the case of a charging current of 10 A but the same conditions otherwise, this yields a clamping time of 1.3 ms, which can be utilized as additional combustion time.

Thus an additional inductor 16, a high-blocking decoupling diode 10 and an auxiliary Darlington 15, which consumes only a reduced clamping voltage of 50 V, for example are needed for implementation of the circuit illustrated in FIG. 5. To prevent loss of power charged in external inductor 16 when charging primary coil 2, it is also advantageous for external inductor 16 to be wound onto the primary side of ignition coil 1. In this case, ignition coil 1 would have two primary windings connected in parallel with a common positive terminal and two separate terminals for the collectors of ignition Darlington 4 and auxiliary Darlington 15. Recharging external inductor 16 via auxiliary Darlington 15 in the combustion phase of ignition Darlington 4 would then take place directly from external inductor 16 to secondary side 3 of ignition coil 1. Decoupling diode 10 between ignition Darlington 4 and auxiliary Darlington 15 could then be optionally omitted because energy would be transferred directly from external inductor 16 to secondary side 3 of the ignition coil.

Figure 6:
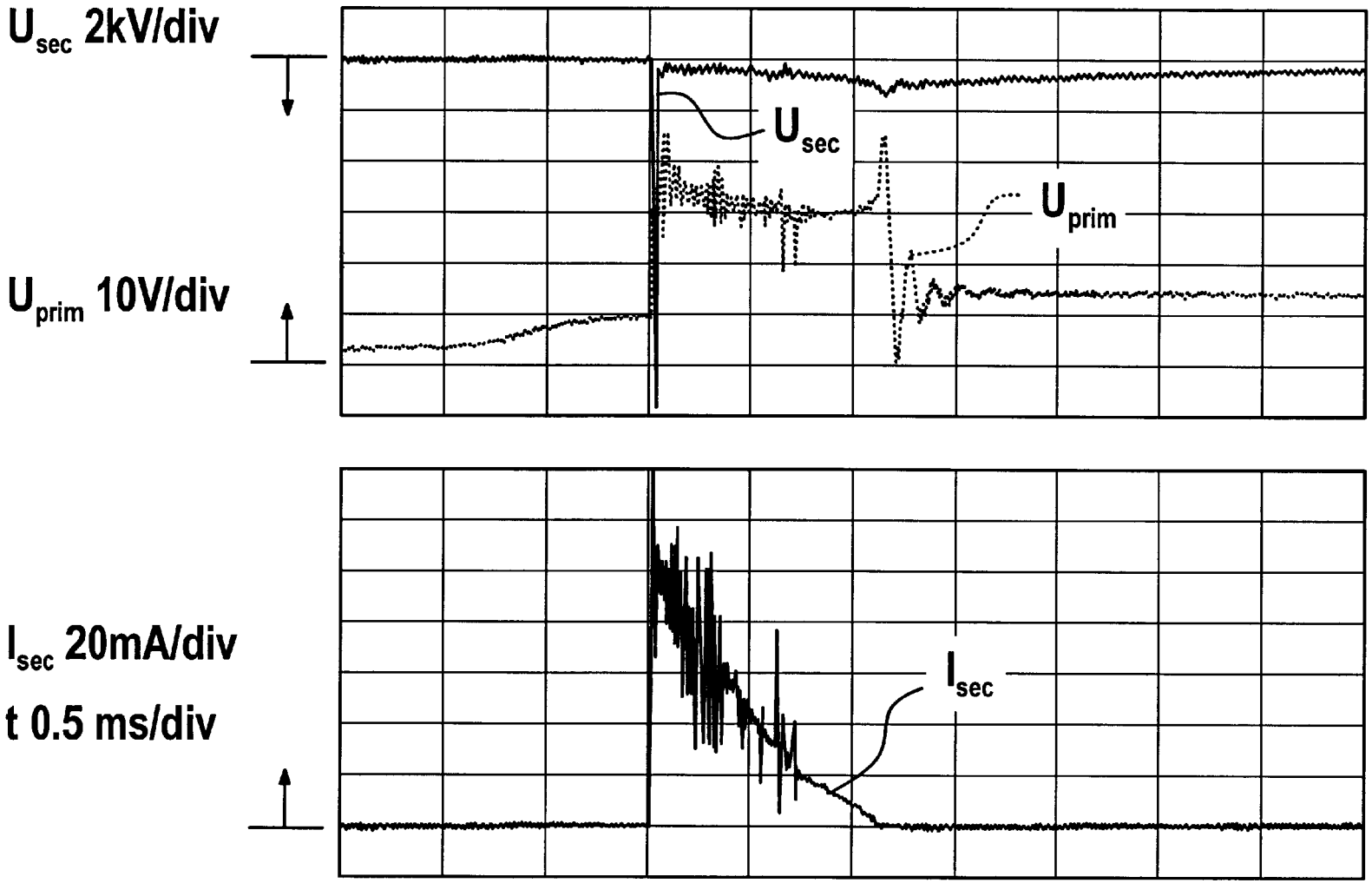
FIG. 6 shows a first illustration of the time characteristics of secondary voltage $U_{sek}$, primary voltage $U_{prim}$ and secondary current $I_{sek}$ for the ignition device illustrated in FIG.

FIG. 6 shows the current and voltage relationships without the second charging circuit with auxiliary Darlington 15 and external inductor 16 and, on secondary side 3, the spark head with a voltage of 13 kV and then the combustion voltage of −300 V, building up to approximately −1.6 kV toward the end of the combustion process. After ignition, the ionic current drops after 1.2 ms from 100 mA to zero. During the combustion phase, transformed combustion voltage having values between 30 V and 40 V is applied to the collector of ignition Darlington 4, returning to the battery voltage at the end of the combustion process.

FIG. 7 shows the relationships for the same process with auxiliary Darlington 15 switched on. The secondary current phase is prolonged from 1.2 ms (FIG. 6) to 1.8 ms. The on-time of auxiliary Darlington 15 was selected so that its switch-off time approximately coincides with the end of the "natural" combustion time. The combustion process is thus prolonged by 0.6 ms, which corresponds to the clamping phase of auxiliary Darlington 15. The combustion voltage transformed on the primary side acts as the voltage limit for auxiliary Darlington 15. In addition, the charging current of auxiliary Darlington 15 on the primary side has also been plotted. It begins suddenly at approximately 4 A because external inductor 16 was also charged in charging ignition Darlington 4 due to its being connected in parallel to primary coil 2. External inductor 16 thus still contains residual energy which is further charged to 6 A, depending on the on-time of auxiliary Darlington 15.

In the variant of an ignition device according to the present invention as explained in conjunction with FIGS. 5 through 7, decoupling diode 10 can be integrated into the ignition Darlington circuit, but auxiliary Darlington 15 is not integratable.

FIG. 8 shows one possibility for alternating connection of two coil-ignition Darlington combinations for mutual recharging of power during the combustion phase of the other coil-ignition Darlington combination. All the circuit components of this circuit can be integrated monolithically into the respective Darlington output stages.

FIG. 8 shows two ignition switch systems 30 and 50 having ignition coils 31 and 51, ignition Darlingtons 34 and 54 and spark plugs 35 and 55 connected in a symmetrical arrangement. Drivers 25 and 26 of ignition Darlingtons 34 and 54 are controlled by a computer (not shown here). In addition, a path may be opened between two primary circuits 32 and 52 of ignition coils 31 and 51 by two oppositely switched npn-Darlingtons 36 and 56, each with its high-blocking collectors being connectable to the collectors (the substrate sides) of ignition Darlingtons 34 and 54, and thus also being integratable. npn-Darlingtons 36 and 56 are each controlled by a voltage-dependent resistor 37 and 57 in the base-collector segment of driver 38 or 58. In order for Darlingtons 36 and 56 not to be controlled incorrectly due to interference voltage, they have base-emitter resistors. These resistors have the effect that they can be controlled only above a base current threshold which depends on the base-emitter resistance (biasing current). For the biasing current, npn-Darlingtons 36 and 56 have an emitter-base resistor 39 and 59 only in the output stage. In addition, there is an inverse diode 40 and 60 parallel to the collector-emitter segment. The current for recharging in the combustion phase flows over inverse diode 40 of npn-Darlington 36 and npn-Darlington 56, which has been switched on, or vice versa. A three-stage npn-Darlington may also be used to increase the base current sensitivity. Again in this case, the driver does not have a base-emitter resistor.

Voltage-dependent resistors 37 and 57 are each implemented in a J-FET like construction having a narrowed cross section. Their design is explained in greater detail below in conjunction with FIG. 10 (J-FET). At a low voltage, they have a value of approximately 5 kΩ, which increases with the voltage. At approximately 100 V, resistors 37 and 57 disconnect one another completely. Short-circuit transistors 41 and 61, connected directly to ground, are provided on the emitter of drivers 38 and 58 of npn-Darlingtons 36 and 56. The base drivers of short-circuit transistors 41 and 61 are connected across 500 Ω resistors 42 and 62. The common connection of the two base terminals is connected to drivers 25 and 26 of ignition Darlingtons 34 and 54 over diodes 43 and 63, so that their base terminals are always high when one (or both) ignition Darlington drivers 25 and 26 is/are at high potential.

FIG. 9 shows schematically the collector-emitter voltages of both ignition Darlingtons 34 and 54. After switching on ignition Darlington 34, collector-emitter voltage $U_{CEon}$ increases until it enters the short clamping phase of ignition Darlington 34. This is followed by the phase of combustion voltage transformed at the primary side, lasting approximately 1 ms. Power supply voltage $U_{Batt}$ of 14 V is applied during the pause. During the on-time of ignition Darlington 34, ignition Darlington 54 also receives current with a time offset. Shortly before the end of the "natural" combustion voltage, ignition Darlington 54 clamps with the combustion voltage of ignition coil 31.

The circuit arrangement illustrated in FIG. 8 functions in all switch states. The trigger conditions, offset in time relative to one another, do not lead to malfunctioning or misfiring on the wrong side of the ignition coil. Furthermore, the two sides of the ignition components are interchangeable, i.e., when ignition Darlington 34 generates an ignition spark, ignition Darlington 54t ensures recharging of the combustion phase and vice versa. Otherwise, the connection of monolithically integrated ignition switch systems 30 and 50 is similar to that of the ignition output stages known in practice. In addition, the emitters of npn-Darlingtons 36 and 56 and control lines 25 and 26, which are isolated over diodes 43 and 63, are connected by plug connections.

The following states are to be discussed:

1. Both ignition Darlingtons 34 and 54 are turned off.
2. Only ignition Darlington 34 is turned on, while ignition Darlington 54 is still turned off.
3. Both ignition Darlingtons 34 and 54 are turned on at the same time.
4. Ignition Darlington 34, which was turned off first, clamps and generates an ignition spark, while ignition Darlington 54 is still turned on.
5. The transformed combustion voltage is applied to the collector of ignition Darlington 34 while ignition Darlington 54 is still turned on.
6. Ignition Darlington 54 is turned off and clamps the transformed combustion voltage, while ignition Darlington 34 is currentless. The combustion process is prolonged by the clamping time of ignition Darlington 54.
7. Clamping of ignition Darlington 54 and the combustion process is terminated.

Re 1:

The collectors of ignition Darlingtons 34 and 54 are at 14 V, and both short-circuit transistors 41 and 61 are deactivated. The path between npn-Darlingtons 36 and 56 is currentless.

Re 2:

The collector of ignition Darlington 34 is at saturation voltage or becomes active. In any case, there is a voltage gradient between the collector of ignition Darlington 54, to which 14 V is applied, and the collector of ignition Darlington 34, to which 2 V to 8 V is applied. However, this voltage gradient does not result in activation of npn-Darlington 56, because short-circuit transistor 61, which is turned on, prevents activation of npn-Darlington 56. Primary side 32 of ignition coil 31 is thus charged, but no cross-current is allowed to flow from primary side 52 of ignition coil 51.

Re 3:

Likewise, opening of the path between primary sides 32 and 52 of two ignition coils 31 and 51 is also prevented when ignition Darlingtons 34 and 54 are triggered simultaneously.

Re 4:

In the clamping phase of ignition Darlington 34, npn-Darlington 36 is prevented from being switched through base-collector resistor 37 which is not conducting at a high voltage. In addition, in the case of possible leakage of base-collector resistor 37 at high temperatures, rev activated short-circuit transistor 41 prevents npn-Darlington 36 from being turned on. npn-Darlington 36 and ignition Darlington 34 diffuse on the same substrate and have the same blocking properties. Thus, npn-Darlington 36 remains blocked when ignition Darlington 34 is clamped. Destruction of short-circuit transistor 41 is prevented because the clamping voltage of ignition Darlington 34 does not penetrate through to the power base of npn-Darlington 36. Ignition occurs in the coil branch whose ignition Darlington is the first to be turned off. Thus, the ignition sequence is not defined by the process of switching on of the ignition stages but instead by their switching-off process.

Re 5:

In the phase when primary side 32 of ignition coil 31 is at the potential of the transformed combustion voltage with ignition Darlington 54 turned on, npn-Darlington 56 remains currentless because short-circuit transistor 61 is activated by the driver of ignition Darlington 54.

Re 6:

Both ignition Darlingtons 34 and 54 are turned off, so both short-circuit transistors 41 and 61 are currentless. npn-Darlington 56 is controlled over base-collector resistor 57, so the current flows from primary side 52 of ignition coil 51 into primary side 32 of ignition coil 31 over npn-Darlington 56, which has been activated, and inverse diode 40 of npn-Darlington 36. The clamping voltage of ignition Darlington 54 is elevated in comparison with the transformed combustion voltage of ignition coil 31 until the voltage drop at base-collector resistor 57 is so high that npn-Darlington 56 is switched through. The increase in voltage between two primary sides 32 and 52 of ignition coils 31 and 51 occurs first due to the voltage drop across inverse diode 40, which is typically 1.5 V at 10 A. Secondly, npn-Darlington 56 is operated actively until it receives enough base current over base-collector resistor 57 to be able to take over the flowing primary current. To reduce this voltage drop, several J-FET resistors may be connected in parallel, but also a sufficient emitter area of npn-Darlington 56 to increase the Darlington gain may be ensured. The clamping voltage of ignition Darlington 54 is at such a low level, preferably below 40 V, that no ignition spark occurs on secondary side 53 of ignition coil 51. The same conditions are to be met here as in the case of a bias current disconnect. If the same pairing of coil-ignition Darlington combinations is selected here as in the case of double-coil ignition, any spark that may occur will ignite into the exhaust flowing out and will not destroy the engine.

Re 7:

After the end of the combustion phase, both primary sides 32 and 52 go back to 14 V, and the cross-current path from npn-Darlington 56 to npn-Darlington 36 becomes currentless again.

FIG. 10 illustrates the construction of a J-FET resistor 70 having a constricted cross section such as that used as a base-collector resistor 37 or 57 in the circuit arrangement illustrated in FIG. 8. J-FET resistor 70 is shown here in the form of a hole in a π-diffusion 71 in a high-resistance $n^{31}$-starter substrate 72 of 60 Ωcm, for example. To improve the ohmic terminal resistance, $n^+$-diffusion 73 is applied to the contact hole. An $n^+$ terminal diffusion 74 approximately 160 μm thick is provided on the back of the substrate. The shape of space charge zone 75 is shown with dotted lines. It expands laterally in the hole in π-diffusion 71 with an increase in voltage between $p^+$ terminal 76 of π-diffusion 71 and the back of the substrate until the current channel is interrupted completely. The expansion of space charge zone 75 as a function of the voltage and specific resistance of the substrate material can be described with the following formula:

$$D(\mu m)=(p\ (\Omega cm)\times U(V)\times 0.27)^{1/2}$$

The switch off voltage is reached when the width of the space charge zone corresponds to half the channel diameter. The channel resistance without applied voltage can be estimated by assuming only a vertical current characteristic. In the following table, the channel diameter has been determined from different channel resistances without applied voltage. For a channel length of 60 μm and p=60 Ωcm, this yields:

| Channel diameter d (μm) | Channel resistance without voltage | Disconnect voltage $V_{off}$ (V) |
|---|---|---|
| 50 μm | 18.34 kΩ | 38.5 V |
| 60 μm | 12.73 kΩ | 55.5 V |
| 70 μm | 9.35 kΩ | 75.6 V |
| 80 μm | 7.16 kΩ | 98.7 V |

The true channel resistance is lower because a current propagation effect is expected under π-diffusion 71. The true channel resistance is therefore approximately 60% to 70% below the value of the calculated vertical channel resistance.

The lowest possible J-FET resistance as base-collector resistance 37 or 57 is desirable for activating npn-Darlingtons 36 and 56 in the circuit arrangement illustrated in FIG. 8. This can be achieved by providing an elongated, strip-shaped hole instead of a round hole in π diffusion 71. The disconnect voltage is determined by the width of the hole, while the reduction factor of the J-FET resistance with respect to the values given in the preceding table is determined by the ratio of the strip length to the strip width. In this way, it is possible to implement resistance values that are lower than those given in the table by a factor of 10.

What is claimed is:

1. An ignition device for an internal combustion engine having multiple cylinders and direct gasoline injection, comprising:

at least one ignition coil provided for each cylinder;

an ignition switch controlled by a microprocessor and for switching a primary side of the at least one ignition coil; and a spark plug connected to a secondary side of the at least one ignition coil;

wherein:

an external voltage can be applied to the at least one ignition coil to prolong a secondary current conduction time, the external voltage can be connected to the primary side of the at least one ignition coil, an auxiliary voltage source can be connected as the external voltage, and the auxiliary voltage source includes a fixed voltage source.

2. The ignition device according to claim 1, wherein the fixed voltage source includes a battery.

3. An ignition device for an internal combustion engine having multiple cylinders and direct gasoline injection, comprising:

at least one ignition coil provided for each cylinder;

an ignition switch controlled by a microprocessor and for switching a primary side of the at least one ignition coil; and a spark plug connected to a secondary side of the at least one ignition coil;

wherein:

an external voltage can be applied to the at least one ignition coil to prolong a secondary current conduction time, the external voltage can be connected to the primary side of the at least one ignition coil, an auxiliary voltage source can be connected as the external voltage, and the auxiliary voltage source includes a 42-volt voltage source.

4. An ignition device for an internal combustion engine having multiple cylinders and direct gasoline injection, comprising:

at least one ignition coil provided for each cylinder;

an ignition switch controlled by a microprocessor and for switching a primary side of the at least one ignition coil;

a spark plug connected to a secondary side of the at least one ignition coil;

a high-side switch; and an npn-switching transistor;

wherein:

an external voltage can be applied to the at least one ignition coil to prolong a secondary current conduction time, the external voltage can be connected to the primary side of the at least one ignition coil, an auxiliary voltage source can be connected as the external voltage, and the auxiliary voltage source can be connected by the high-side switch in combination with the npn-switching transistor.

5. An ignition device for an internal combustion engine having multiple cylinders and direct gasoline injection, comprising:

at least one ignition coil provided for each cylinder;

an ignition switch controlled by a microprocessor and for switching a primary side of the at least one ignition coil;

a spark plug connected to a secondary side of the at least one ignition coil;

a high-side switch; and an npn-switching transistor;

wherein:

an external voltage can be applied to the at least one ignition coil to prolong a secondary current conduction time, the external voltage can be connected to the primary side of the at least one ignition coil, an auxiliary voltage source can be connected as the external voltage, and the high-side switch includes one of a pnp-Darlington transistor and an n-MOSFET transistor.

6. The ignition device according to claim 5, wherein:

the high-side switch is integrated into a control circuit in bipolar CMOS-DMOS(BCD) technology.

7. An ignition device for an internal combustion engine having multiple cylinders and direct gasoline injection, comprising:

at least one ignition coil provided for each cylinder;

an ignition switch controlled by a microprocessor and for switching a primary side of the at least one ignition coil;

a spark plug connected to a secondary side of the at least one ignition coil;

a high-side switch;

an npn-switching transistor; and a zener diode;

wherein:

an external voltage can be applied to the at least one ignition coil to prolong a secondary current conduction time, the external voltage can be connected to the primary side of the at least one ignition coil, an auxiliary voltage source can be connected as the external voltage, the high-side switch includes a pnp-Darlington transistor, and a base-collector segment of the pnp-Darlington transistor is clamped with the Zener diode.

8. The ignition device according to claim 7, wherein:

the Zener diode includes a 50-volt Zener diode.

9. An ignition device for an internal combustion engine having multiple cylinders and direct gasoline injection, comprising:

at least one ignition coil provided for each cylinder;

an ignition switch controlled by a microprocessor and for switching a primary side of the at least one ignition coil;

a spark plug connected to a secondary side of the at least one ignition coil;

a high-side switch; and an npn-switching transistor;

wherein:

an external voltage can be applied to the at least one ignition coil to prolong a secondary current conduction time, the external voltage can be connected to the primary side of the at least one ignition coil, an auxiliary voltage source can be connected as the external voltage, the ignition switch includes an ignition transistor connected upstream from a primary winding of the at least one ignition coil, an isolating element connected between a collector of the high-side switch and a collector of the ignition transistor, the isolating element includes a decoupling diode corresponding to a Zener diode, and a Zener voltage of the Zener diode is greater than a maximum clamping voltage of the ignition transistor.

10. The ignition device according to claim 9, wherein:

the ignition transistor includes one of an ignition Darlington transistor and an IGBT.

11. The ignition device according to claim 9, wherein:

the decoupling diode is integrated into the ignition transistor.

12. The ignition device according to claim 9, wherein:

a charging current of the ignition transistor is so small that ignition is still guaranteed and a length of a subsequent combustion process is determined by an on-time of the high-side switch.

13. An ignition device for an internal combustion engine having multiple cylinders and direct gasoline injection, comprising:

at least one ignition coil provided for each cylinder;

an ignition switch controlled by a microprocessor and for switching a primary side of the at least one ignition coil;

a spark plug connected to a secondary side of the at least one ignition coil;

a high-side switch; and an npn-switching transistor;

wherein:

an external voltage can be applied to the at least one ignition coil to prolong a secondary current conduction time, the external voltage can be connected to the primary side of the at least one ignition coil, an auxiliary voltage source can be connected as the external voltage, and an on-time of the high-side switch is selected so that the on-time overlaps with an end of a first combustion phase of the spark plug and ends shortly before a zero pass of a combustion current in a second combustion phase, so that the combustion current can then decay from a negative current value to zero in an inverse combustion phase.

14. An ignition device for an internal combustion engine having multiple cylinders and direct gasoline injection, comprising:

at least one ignition coil provided for each cylinder;

an ignition switch controlled by a microprocessor and for switching a primary side of the at least one ignition coil;

a spark plug connected to a secondary side of the at least one ignition coil;

a high-side switch; and an npn-switching transistor;

wherein:

an external voltage can be applied to the at least one ignition coil to prolong a secondary current conduction time, the external voltage can be connected to the primary side of the at least one ignition coil, an auxiliary voltage source can be connected as the external voltage, and an on-time of the high-side switch is selected to be approximately zero, as desired by the user, and can be ramped up in a critical starter situation, so that a total combustion time of the spark plug is prolonged due to an associated inverse combustion time.

15. An ignition device for an internal combustion engine having multiple cylinders and direct gasoline injection, comprising:

at least one ignition coil provided for each cylinder;

an ignition switch controlled by a microprocessor and for switching a primary side of the at least one ignition coil; and a spark plug connected to a secondary side of the at least one ignition coil;

wherein:

an external voltage can be applied to the at least one ignition coil to prolong a secondary current conduction time, the external voltage can be connected to the primary side of the at least one ignition coil, and a disconnect voltage of an auxiliary circuit having an auxiliary switch and an external inductor can be applied as the external voltage.

16. An ignition device for an internal combustion engine having multiple cylinders and direct gasoline injection, comprising:

at least one ignition coil provided for each cylinder;

an ignition switch controlled by a microprocessor and for switching a primary side of the at least one ignition coil; and a spark plug connected to a secondary side of the at least one ignition coil;

wherein:

an external voltage can be applied to the at least one ignition coil to prolong a secondary current conduction time, the external voltage can be connected to the primary side of the at least one ignition coil, a disconnect voltage of an auxiliary circuit having an auxiliary switch and an external inductor can be applied as the external voltage, the ignition switch includes an ignition Darlington transistor connected upstream from a primary winding of the at least one ignition coil, the auxiliary switch includes an auxiliary Darlington transistor, and the auxiliary Darlington transistor is connected upstream from the external inductor, the external inductor being in turn connected in parallel with the primary winding of the at least one ignition coil.

17. The ignition device according to claim 16, wherein:

an isolating element is connected between a collector of the disconnectable auxiliary Darlington transistor and a collector of the ignition Darlington transistor, and the isolating element includes a decoupling diode corresponding to a Zener diode, the Zener diode having a Zener voltage that is greater than a maximum clamping voltage of the ignition Darlington transistor.

18. The ignition device according to claim 17, wherein:

the external inductor is wound on the primary side of the at least one ignition coil so that the external inductor is connected in parallel with the primary winding of the at least one ignition coil and has a common positive terminal with the primary winding, a second terminal of the external inductor is connected to the collector of the auxiliary Darlington transistor, and a second terminal of the primary winding is connected to the collector of the ignition Darlington transistor.

19. The ignition device according to claim 16, wherein:

a triggering of the auxiliary Darlington transistor is timed so that a disconnect phase thereof corresponds to an end of a combustion current caused by the ignition Darlington transistor on the secondary side of the at least one ignition coil.

20. An ignition device for an internal combustion engine having cylinders and direct gasoline injection, comprising:

ignition coils, wherein at least one of the ignition coils is a first main ignition coil associated with a first one of the cylinders, and is a first auxiliary ignition coil associated with a second one of the cylinders, and wherein at least another one of the ignition coils is a second main ignition coil associated with the second one of the cylinders, and is a second auxiliary ignition coil associated with the first one of the cylinders;

an ignition switch controlled by a microprocessor and for switching a primary side of each of the ignition coils; and a spark plug connected to a secondary side of each of the ignition coils;

wherein whenever an ignition spark is produced via one of the main ignition coils which is active, its auxiliary ignition coil, which is inactive can be connected as an auxiliary circuit to produce an external voltage;

wherein:

the external voltage can be applied to the at least one ignition coil to prolong a secondary current conduction time, and the external voltage can be connected to the primary side of at least one of the ignition coils.

21. The ignition device according to claim 20, wherein:

the cylinder of the one of the ignition coils that is inactive is in an exhaust phase.

22. The ignition device according to claim 20, wherein:

each of the ignition coils includes an ignition Darlington transistor connected upstream from a respective primary winding thereof, one of a two-stage npn Darlington transistor and a three-stage npn-Darlington transistor is connected to each ignition Darlington transistor of the ignition coils, so that a collector of each ignition Darlington transistor of the ignition coils is at the same potential as a collector of the respective one of the two-stage npn Darlington transistor and the three-stage npn-Darlington transistor, and emitters of each of the one of the two-stage npn Darlington transistor and the three-stage npn-Darlington transistor are linked together over plug connector lines.

23. The ignition device according to claim 22, wherein:

each one of the one of the two-stage npn Darlington transistor and the three-stage npn-Darlington transistor is monolithically integrated.

24. The ignition device according to claim 22, wherein:

each one of the one of the two-stage npn Darlington transistor and the three-stage npn-Darlington transistor is connected to a respective driver, and each one of the one of the two-stage npn Darlington transistor and the three-stage npn-Darlington transistor is triggered via a respective J-FET resistor connected to a base-collector segment of the respective driver.

25. The ignition device according to claim 24, wherein:

each J-FET resistor is monolithically integrated.

26. The ignition device according to claim 24, wherein:

a channel resistance of each J-FET resistor is very high at a high clamping voltage, so that each respective one of the one of the two-stage npn Darlington transistor and the three-stage npn-Darlington transistor is disconnected at the high clamping voltage.

27. The ignition device according to claim 26, wherein:

each J-FET resistor is implemented as a strip-shaped hole in a $\pi$-diffusion in a high-resistance starter substrate, a disconnect voltage of each J-FET resistor being defined by a width of the strip-shaped hole.

28. The ignition device according to claim 27, further comprising:

a short-circuit transistor provided for each one of the one of the two-stage npn Darlington transistor and the three-stage npn-Darlington transistor, wherein:

a collector of the short-circuit transistor is connected to a power base of the one of the two-stage npn Darlington transistor and the three-stage npn-Darlington transistor, and an emitter of the short-circuit transistor is at ground and a base of the short-circuit transistor is connected to the driver of the respective ignition Darlington transistor across a protective resistor and a further diode.

29. The ignition device according to claim 28, wherein:

a control line of the short-circuit transistor is connected to a control line of another short-circuit transistor at a cathode point of the further diode.

30. The ignition device according to claim 29, wherein:

an inverse diode is connected to an emitter-collector segment of the one of the two-stage npn Darlington transistor and the three-stage npn-Darlington transistor, and a cross-path between the primary sides of the additional ignition coils is opened by switching one of the one of the two-stage npn Darlington transistor and the three-stage npn-Darlington transistor via a transformed combustion voltage of the ignited branch and making a current flow over the inverse diode of another one of the one of the two-stage npn Darlington transistor and the three-stage npn-Darlington transistor when none of the ignition Darlington transistors is activated.

* * * * *

UNITED STATES PATENT AND TRADEMARK OFFICE

CERTIFICATE OF CORRECTION

PATENT NO. : 6,705,302 B2
DATED : March 16, 2004
INVENTOR(S) : Horst Meinders

It is certified that error appears in the above-identified patent and that said Letters Patent is hereby corrected as shown below:

Column 4,
Line 58, change "Usec[[Usck]](v)" to -- Usec[[Usck]](V) --.

Column 9,
Line 27, change "high temperatures, rev activated" to -- high temperatures, activated --.

Column 10,
Line 18, change "$n^{31}$-starter" to -- $n^{-}$-starter --.

Signed and Sealed this

Fourth Day of January, 2005

JON W. DUDAS
*Director of the United States Patent and Trademark Office*